United States Patent [19]

Yanobu

[11] Patent Number: 4,782,653

[45] Date of Patent: Nov. 8, 1988

[54] DEVICE FOR DISPLACING A TENSER IN A TWO-FOR-ONE TWISTER

[75] Inventor: Hideo Yanobu, Kyoto, Japan

[73] Assignee: Murata Kikai Kabushiki Kaisha, Kyoto, Japan

[21] Appl. No.: 66,420

[22] PCT Filed: Oct. 15, 1985

[86] PCT No.: PCT/JP85/00575

§ 371 Date: Jun. 5, 1987

§ 102(e) Date: Jun. 5, 1987

[87] PCT Pub. No.: WO87/02393

PCT Pub. Date: Apr. 23, 1987

[51] Int. Cl.[4] ..... D01H 13/10; D01H 7/86; B65H 59/22

[52] U.S. Cl. ..... 57/279; 57/58.83; 57/58.86; 242/147 R; 242/149

[58] Field of Search ..... 57/58.83, 58.86, 279, 57/280, 58.49; 242/147 R, 149, 152.1

[56] References Cited

U.S. PATENT DOCUMENTS

| | | | |
|---|---|---|---|
| 4,281,508 | 8/1981 | Frentzel-Beyme | 57/279 |
| 4,287,712 | 9/1981 | Franzen | 57/279 |
| 4,355,500 | 10/1982 | Yanobu et al. | 57/279 |
| 4,357,792 | 11/1982 | D'Agnolo et al. | 57/279 |
| 4,377,065 | 3/1983 | Yanobu | 57/279 |
| 4,391,090 | 7/1983 | Charbonnier | 57/279 |
| 4,453,377 | 6/1984 | Inger et al. | 57/279 |
| 4,642,980 | 2/1987 | Fukunaga et al. | 57/58.86 |

FOREIGN PATENT DOCUMENTS

| | | |
|---|---|---|
| 52-63443 | 5/1977 | Japan . |
| 57-143530 | 9/1982 | Japan . |
| 59-103778 | 7/1984 | Japan . |

*Primary Examiner*—John Petrakes

*Attorney, Agent, or Firm*—Spensley Horn Jubas & Lubitz

[57] ABSTRACT

A tenser displacing device in a two-for-one twister comprising a cylindrical housing 6 inserted into a take-up tube 5 of a yarn supply package 4 placed on a stationary disk 1 of a two-for-one twister, a lower supporting member 6 secured within the housing 6, a yarn guide pipe 9 inserted into the housing 6 and movable up and down, an upper supporting member 10 secured to the yarn guide pipe, and a tenser 7 held between the lower supporting member and the upper supporting member, wherein a cam member 14 formed in the outer periphery with a cam groove 13 in engagement with a pin 21 projected into the housing 6 is provided on the yarn guide pipe 9 urged by a spring, and the housing 6 is partly provided with a magnet 22 for attracting and holding the tenser 7 at a position displaced from a yarn running area.

7 Claims, 4 Drawing Sheets

DEVICE FOR DISPLACING A TENSER IN A TWO-FOR-ONE TWISTER

BACKGROUND OF THE INVENTION

1. Field of the Invention

The present invention relates to a device for displacing a tenser in a two-for-one twister in which a tension applying device is installed within a center hole of a yarn supply package.

2. Description of the Related Art

A two-for-one twister houses therein a tension applying device. That is, in a tension device installed within a center hole of a yarn supply package, a capsule type or a spherical tenser is provided in part of a yarn passing hole, and tension is applied to a yarn while nipping the yarn under constant pressure between the tenser and the tenser supporting member.

In case of such a tension device, in threading operation, it is necessary to displace the tenser from a yarn passage to provide freedom without any abstacle in the yarn passage. Where threading is carried out by a guide means such as flexible nylon, or where threading is carried out by air stream, it is necessary to displace the tenser to a position not to cutoff an air stream passage.

Various tenser displacing devices have been proposed. However, some of these devices are inconvenient in positiveness of displacement of the tenser. That is, a tenser is displaced by compressed air; a push rod having a tapered end is inserted into a yarn guide hole to directly and forcibly displace the tenser; or a pin is projected from a cylindrical side to forcibly move the pin in a lateral direction. However, these proposals have disadvantages such that in case of using the compressed air, there involves inaccuracy in operation due to variation in air pressure and air leakage; in case of inserting the displacing push rod, the operation is cumbersome; and in case of pushing a pin from the side, the directivity of operation need be determined.

SUMMARY OF THE INVENTION

An object of the present invention is to provide a device for displacing a tenser positively to a predetermined position by an extremely simple operation.

According to the device for displacing a tenser of an embodiment of the present invention, the tenser is held between a lower supporting member secured within a tenser housing and an upper supporting member inserted into the housing and secured to a vertically movable yarn guide pipe, a cam member formed in the outer periphery with a cam groove in engagement with a pin projected into the housing to locate upper and lower position of the yarn guide pipe is provided in axial position of the yarn guide pipe, said yarn guide pipe being urged by a spring in an axial direction of the yarn guide pipe, and a magnet for attracting and holding the tenser at a position displaced from a yarn running area is provided in part of the housing.

According to an embodiment of the present invention, the yarn guide pipe is pushed against the force of a spring to bring the cam member into engagement with the pin so that the cam member may be moved up and down integral with the yarn guide pipe, and when a spacing between the upper and lower supporting members, the tenser present therebetween is attracted and held by the magnet on the side to form a threading passage.

DESCRIPTION OF THE PREFERRED EMBODIMENT

An embodiment of the present invention will be described hereinafter with reference to the drawings.

Figure 1:
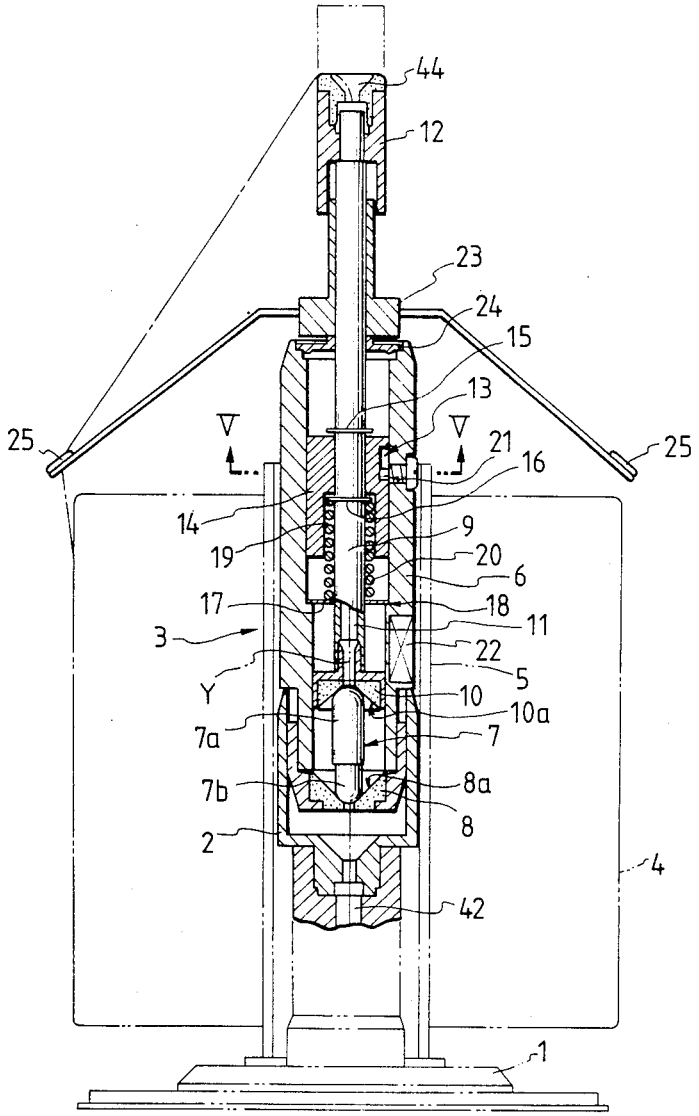
FIG. 1 is a front view in section showing an embodiment of a device according to the present invention.

In FIG. 1, a tenser device 3 is mounted on a support pipe 2 on a stationary disk 1 of a two-for-one twister. A yarn supply package 4 is placed on the stationary disk 1, and the tenser device 3 is inserted into a take-up tube 5 of the yarn supply package 4.

The tenser device 3 comprises a cylindrical housing 6, a member 8 for supporting a lower portion of a tenser 7 threadedly mounted on the lower portion of the housing 6, a member 10 for supporting an upper portion of the tenser secured to the lower end of a yarn guide tube 9 inserted into the housing 6, and the tenser 7 clamped and held between the upper and lower supporting members 10 and 8. In the illustrated embodiment, the tensor 7 is a capsule-shaped sensor composed of an upper cap 7*a* and a lower cap 7*b* which are slidably fitted each other, the upper and lower caps 7*a* and 7*b* being urged in a direction of moving away from each other by means of a spring encased therein, said upper cap 7*a* having its upper semispherical portion being positioned, during operation, on an open center line of the upper supporting member 10 having a downwardly spreading conical surface 10*a*, and said lower cap 7*b* having its lower semispherical portion being positioned on an open center line of the lower supporting member 8 having an upwardly spreading conical surface 8*a*.

The yarn guide tube 9 having the upper supporting member 10 secured to the lower end thereof is formed with an axially extending yarn passing hose 11, and a detachable yarn guide 12 is mounted on the upper end thereof. A cam member 14 formed with a cam groove 13, which will be described later, in the outer periphery thereof is defined only vertically by washers 15 and 16 in an intermediary position interiorly of the housing 6 of the yarn guide tube 9, said cam member 14 being pivotable around the yarn guide tube 9. Further, within the housing 6, a partitioning plate 17 having a center hole is placed on a stepped portion 18, and a spring 20 is retained between the partitioning plate 17 and the washer 16 within a center recess 19 of the cam member 14. With this, the yarn guide tube 9 is always urged axially and upwardly by means of the spring 20.

On the other hand, a pin 21 extending into the cam groove 13 is threadedly mounted in a position corresponding to the cam groove 13 of the cam member 14 of the housing 6, the pin 21 serving as a locating means for upper and lower two positions of the yarn guide tube and the upper supporting member 10 of the tenser in terms of the cam groove 13 of the cam member 14. A magnet 22, which is positioned at a part of the housing 6, i.e., in the neighbourhood of the tenser 7, is embedded from the exterior of the housing, said magnet 22 attracts and holds the tenser 7 in a position deviated from the yarn running area when the upper supporting member 10 is in the upper position.

Reference numeral 23 designates a flyer boss placed on a brake plate 24 to secure fliers 25, 25.

Figure 2:
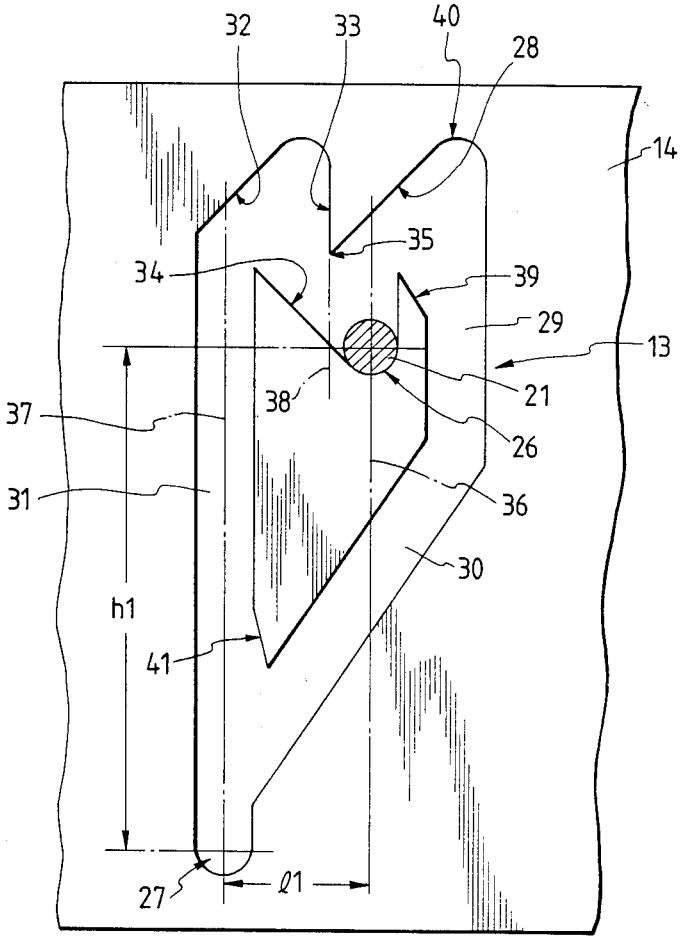
FIG. 2 is a developed front view showing a cam groove of a cam member.

The relationship between the cam groove 13 formed in the outer periphery of the cam member 14 and the pin 21 positioned within and secured to the cam groove is shown in FIG. 2. FIG. 2 is a view developing the cam groove 13, which is actually formed on a curve in the range of a given angle of the outer peripheral surface of the cam member 14. In FIG. 2, the cam groove 13 comprises a first recess 26 for determining a lower position of the cam member 14 and a second recess 27 for determining an upper position of the cam member 14, said recesses 26 and 27 being formed at a spacing of the distance 1 in the circumferential direction and at a spacing of the distance h1 in a vertical direction. The first recess 26 is continuous to the second recess 27 by a first guide surface 28, a first guide groove 29 parallel to the axis and a second guide groove 30 in a state inclined to the axis, and the second recess 27 is continuous to the first recess by a third guide groove 31 extending parallel to the axis from the second recess 27, a second guide surface 32 inclined from the guide groove 31 toward the first recess 26, a third guide surface 33 and a fourth guide surface 34 to form the guide groove in the form of a closed loop. The junction 35 of the first guide surface 28 and the third guide surface 33 is positioned at least between the center line 36 of the first recess 26 and the center line 37 of the second recess 27 and at a position when the extending line of the third guide surface 33 intersects with the fourth guide surface 34. The first guide groove 29 is further formed at the inlet with a tapered surface 39 to smooth the movement of the pin 21 from the first guide surface 28 to the first guide groove through a direction changing portion 40. In addition, the third guide groove 31 is formed at the inlet with a tapered surface 41 to smooth the movement of the pin 21 from the second recess 27 to the third guide groove 31.

Next, the operation of the above-described device will be explained. In the normal operation, the yarn guide pipe 9 is in the state of FIG. 1, that is, in the lower position, and a suitable tension is applied to the yarn Y by the tenser 7 held between the lower and upper supporting members 10. Thus the relationship between the cam groove 13 and the pin 12 is in the state shown in FIG. 3-A.

When the yarn is cut or broken, or during threading at the time of exchanging a yarn supply package, an operator once pressed down the upper end of the yarn guide pipe 9. More specifically, the yarn guide pipe 9 is forced down through the distance 1L against the force of the spring 20, and the cam member 14 secured to the yarn guide pipe 9 moves downwardly accordingly. Then, the first guide surface 28 is guided by the fixed pin 21 to assume the position shown in FIG. 3-B. At that time, the cam member 14 is rotable around the yarn guide pipe 9, and therefore the cam member rotates leftward in FIG. 3-B while being pressed down. In the position shown in FIG. 3-B, when the operator releases its pressing force, that is, when the operator releases his hand, the yarn guide pipe 9 is moved upwardly by the force of the spring 20. Then, the cam member 14 moves upward as if the pin 21 moves in the first guide groove 29, and the second guide groove 30 is defined by the pin 21 with the result that the cam member 14 rotates rightward in FIG. 3-B around the yarn guide tube 9 and the pin 21 assumes the position of FIG. 3-C i.e., the second recess 27. That is, the upper position of the yarn guide pipe 9 is determined, and the tenser 7 held between the upper supporting member at the lower end of the yarn guide pipe 9 and the lower supporting member 8 is released from its holding into a free state as shown in FIG. 4, whereby the tenser is attracted on the inner peripheral surface of the housing 6 on the side of the near magnet 22. At that time, the inner peripheral surface of the housing is in the curved surface, and thus the tenser 7 assumes the attitude along the slant line of the inner peripheral surface to be positioned outwardly of a straight line 43 connecting the yarn passing hole 11 of the yarn guide pipe 9 and the yarn guide hole 42 within the lower supporting tube 2, rendering the yarn running area free. Under this condition, when downwardly-directed air is applied into the yarn passing hole 11 to guide the yarn end Y1 released from the yarn supply package 4 to the center hole 44 of the guide 12 for the yarn on the upper end of the yarn guide pipe 9, the yarn end gets on a stream of air and moves out sideway of a rotary disc of a spindle not shown through the yarn guide pipe 9, a tenser chamber 45, a lower yarn guide hole 42 and the like as shown in FIG. 4 for threading.

Figure 3:
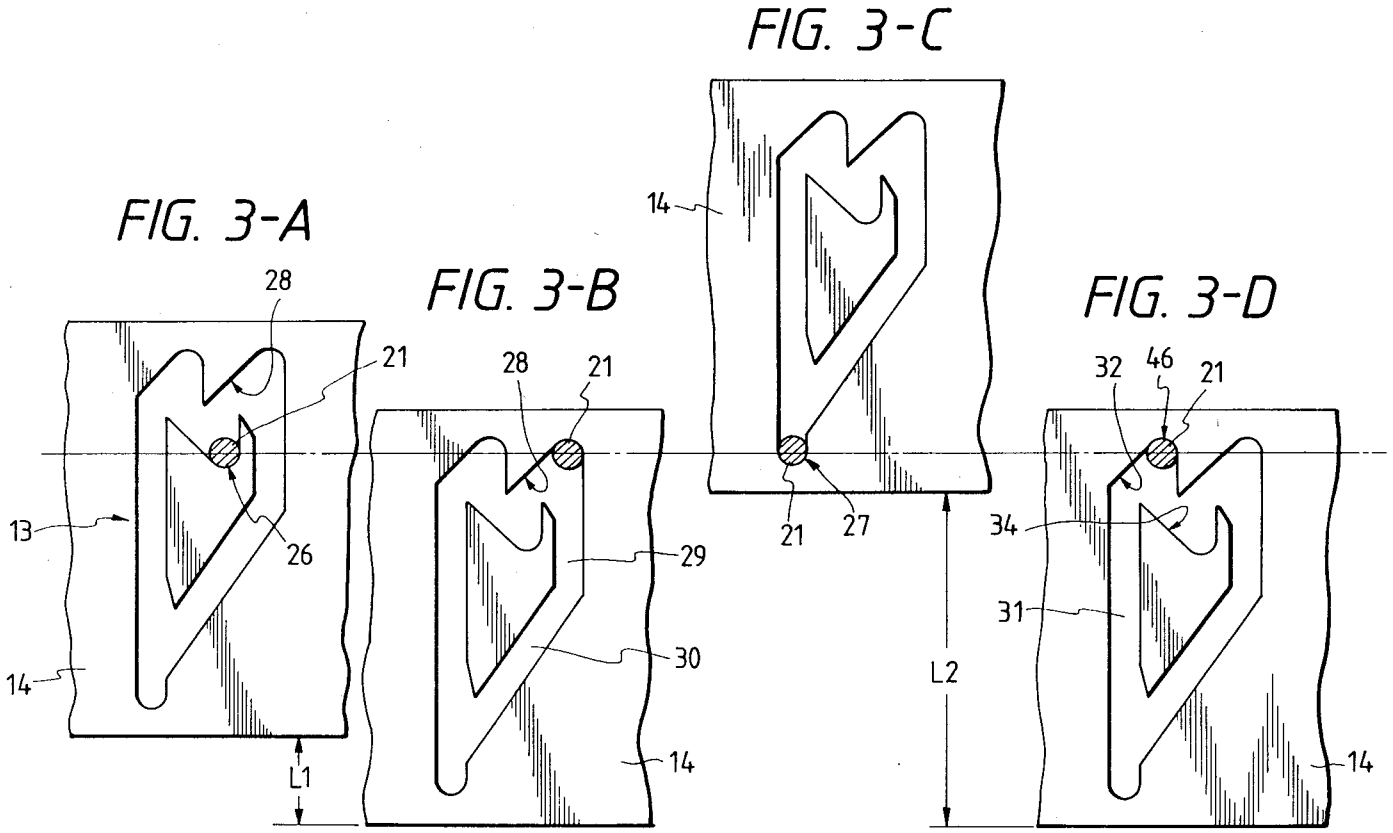
FIGS. 3-A, 3-B, 3-C and 3-D is a view for explanation of operation showing the engaging relationship between a cam groove and a pin.
Figure 4:
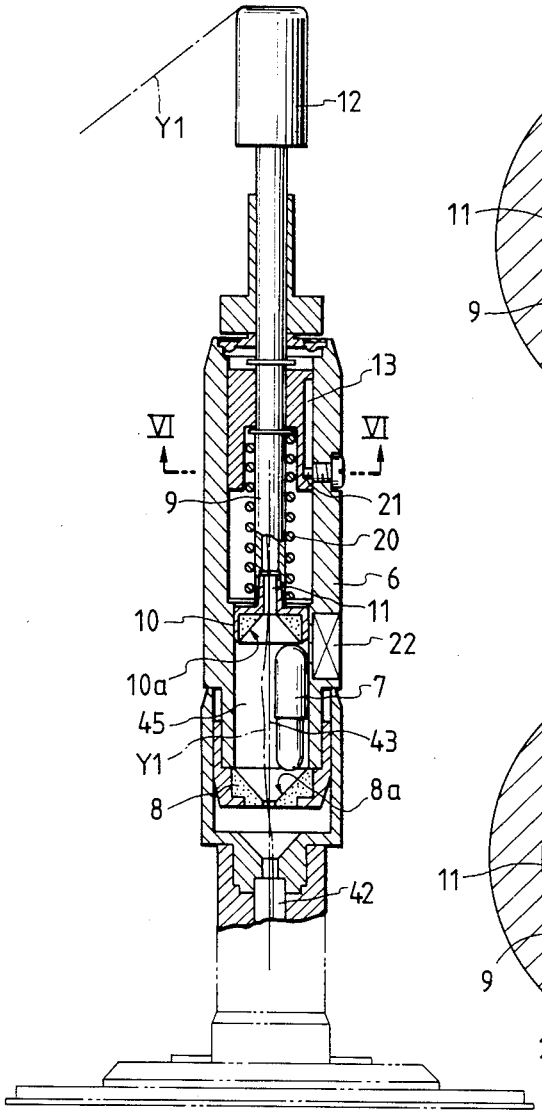
FIG. 4 is a front view in section showing the state wherein a tenser is attracted on a magnet.

After completion of the threading, the operator again pushes down the yarn guide pipe 9 in the position of FIG. 3-C or the upper position against the force of the spring 20. At that time, the cam member 14 rotates downwardly and leftward in FIG. 3-C so that the pin 21 passes along the third guide groove 31 while being defined by the second inclined guide surface 32, and when the pin arrives at the position of FIG. 3-D or the direction changing portion 46, and when the operator releases his hand, the yarn guide pipe 9 and the cam member 14 are moved upwardly by the force of the spring 20, and the fourth guide surface 34 engages the pin 21 whereby the cam member 14 rotates leftward from the position of FIG. 3-D and returns to the state of FIG. 3-A.

Figure 5:
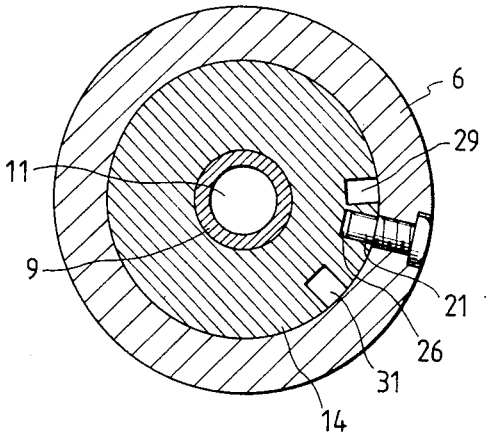
FIG. 5 is a sectional view taken on line V—V of FIG. 1.
Figure 6:
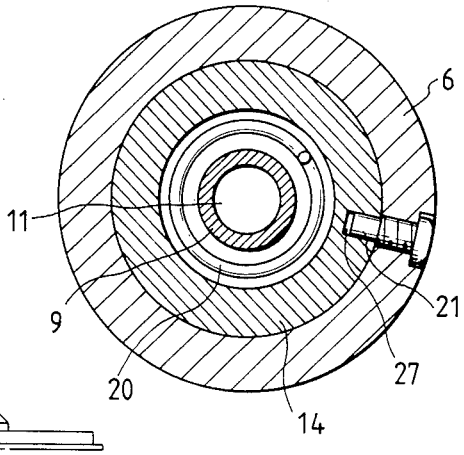
FIG. 6 is a sectional view taken on line VI—VI of FIG. 4.

FIG. 5 is a sectional view taken at a right angle to the axial direction of the yarn guide pipe passing the pin 21 in FIG. 1, and FIG. 6 is a sectional view passing the pin 21 in FIG. 4.

Accordingly, in the aforesaid threading, the tenser 7 may be displaced to a predetermined position by the operator who merely simply pushes down the yarn guide pipe 9 twice against the spring. The first push-down operation is the push-down operation through distance 1L from FIG. 3-A to FIG. 3-B, and the second operation is the push-down operation through distance L2 from FIG. 3-C to FIG. 3-D. When the tenser 7 is returned to the normal operating position or the position of FIG. 1, the yarn guide pipe 9 is pushed downwardly from the state of FIG. 4 whereby the upper spherical portion of the cap 7*a* of the tenser 7 is pushed by the upper supporting member 10 at the lower end of the yarn guide pipe, and the tenser 7 undergoes the aligning action by the conical surface 10*a* of the upper supporting member 10 and the conical surface 8*a* of the lower supporting member 8 so that the tenser 7 may be moved toward the center position. In the present device, when the tenser is displaced, the tenser is in a free state. Therefore, the tenser may be smoothly moved on the upwardly widening conical surface 8*a* on the lower supporting member 8 by the attraction of the magnet 22. When returning to the original position, the tenser 7 is pushed by the upper supporting member 10, whereby the tenser 7 slips down on the conical surface 8*a* of the lower supporting member, thus providing positive tenser displacing and returning operation.

While in the above-described embodiment, the cam member 14 is provided on the yarn guide tube 9 and the fixed pin 21 is provided on the side of the housing 6, it is noted that the reversal may also be employed. More specifically, the cam groove 13 is not provided in the cam mamber 14 of FIG. 1 but a pin is secured thereto, and the cam groove 13 is formed in the inner peripheral surface of the housing 6 in the inverted fashion. With this arrangement, the tenser may be displaced exactly in the same operation as the above-described operation.

As described above, according to an embodiment of the present invention, the tenser displacing operation at the time of threading may be carried out merely by downwardly pushing the yarn guide pipe. The device provides a tenser displacing device which is excellent in workability, and particularly in a throwing works having a number of two-for-one twisters, the threading work may be carried out efficiently in a short period of time.

What is claimed is:

1. A device for displacing a tenser in a two-for-one twister, comprising:

a cylindrical housing;

a lower supporting member secured within the housing;

a yarn guide pipe inserted into the housing and being movable up and down;

an upper supporting member secured to the yarn guide pipe;

a tenser held between the lower supporting member and the upper supporting member;

a means for locating upper and lower positions of said yarn guide pipe;

a spring for axially urging the yarn guide pipe; and a magnet provided on the housing to attract and hold the tenser at a position displaced from a yarn running area;

wherein the means for locating upper and lower positions of the yarn guide pipe comprises a pin and a cam member formed with a cam groove in engagement with the pin;

wherein said pin is provided to be projected into the housing, and said cam member has a cam groove for locating upper and lower positions of the yarn guide pipe, said cam member being rotatably disposed around the yarn guide pipe whereby said cam groove is formed about the outer periphery of the yarn guide pipe; and wherein the cam groove comprises a first recess for determining a lower position of the cam member, a second recess for determining an upper position of the cam member, a first guide groove and a second guide groove to make the first recess continuous to the second recess, and a third guide groove to make the second recess continuous to the first recess to thereby form a guide groove in the form of a closed loop.

2. The device according to claim 1, further comprising a guide surface projecting toward the first recess, said guide surface being disposed between the first guide groove and the third guide groove, said guide surface having a projected forward end positioned between center lines of the first and the second recesses which are parallel to the axis of the yarn guide pipe.

3. The device according to claim 1, wherein the surfaces of the upper supporting member and lower supporting member which are in abutment with the tenser are substantially conical shaped surfaces, respectively.

4. The device according to claim 1, wherein said pin is secured to the yarn guide pipe, and said housing has an inner peripheral surface in which is located a cam groove for engagement with the pin.

* * * * *